US005531401A

United States Patent [19]

Newcomb

[11] Patent Number: 5,531,401

[45] Date of Patent: Jul. 2, 1996

[54] TOY SIMULATED HOT-AIR BALLOON

[76] Inventor: Elliott S. Newcomb, 4019 Simms Dr., Kensington, Md. 20895

[21] Appl. No.: 302,257

[22] Filed: Sep. 8, 1994

Related U.S. Application Data

[63] Continuation-in-part of Ser. No. 76,413, Jun. 14, 1993, abandoned.

[51] Int. Cl.[6] ..... A63H 27/10

[52] U.S. Cl. ..... 244/31; 446/225; 446/222; 40/214

[58] Field of Search ..... 244/31, 32, 33, 244/127; 446/220–226; 40/212–217

[56] References Cited

U.S. PATENT DOCUMENTS

| | | | |
|---|---|---|---|
| 1,208,232 | 12/1916 | Taylor | 446/222 |
| 1,370,178 | 3/1921 | Albert . | |
| 1,478,755 | 1/1923 | Mulholland . | |
| 2,409,166 | 10/1946 | Tracy et al. | 244/33 |
| 2,492,800 | 12/1949 | Isom | 244/31 |
| 2,635,387 | 4/1953 | Anderson | 446/221 |
| 2,792,669 | 5/1957 | Jackson et al. | 446/224 |
| 2,927,383 | 3/1960 | Longino | 446/221 |
| 2,992,795 | 7/1961 | Fazio et al. . | |
| 3,871,422 | 3/1975 | Elson et al. | 446/222 |
| 4,142,322 | 3/1979 | Zeyra | 446/224 |
| 4,145,838 | 3/1979 | Mason | 446/220 |
| 4,529,018 | 7/1985 | Lichfield . | |
| 4,758,199 | 7/1988 | Tillotson et al. . | |
| 4,784,628 | 11/1988 | McArdle et al. . | |
| 4,810,223 | 3/1989 | Stockton | 446/225 |
| 4,884,987 | 12/1989 | Mason . | |
| 5,295,891 | 3/1994 | Schalk | 446/222 |

*Primary Examiner*—Galen L. Barefoot

[57] ABSTRACT

This invention provides improvements to flying toy models of hot-air balloons which use helium instead of hot air for lift.

An object in the shape of an inverted receptacle is inserted into the mouth of the lifting envelope and serves to accurately replicate the shape of the neck and the open mouth of a full-sized hot-air balloon lifting envelope. A novel method of assembly incorporates the inverted receptacle into the lifting envelope and provides for the efficient attachment and detachment of the gondola to the lifting envelope.

10 Claims, 3 Drawing Sheets

TOY SIMULATED HOT-AIR BALLOON

CROSS-REFERENCE TO RELATED APPLICATIONS

1. This application is a continuation-in-part to application Ser. No. 08,076,413 filed Jun. 14, 1993, now abandoned, for Improvements to Toy Simulated Hot-Air Balloon.

2. Simulative Toy Balloon, application Ser. No. 29,011, 207, Preliminary Class D21, filed by applicant on Jul. 30, 1993.

FIELD OF INVENTION

This invention relates to improvements to toy miniature hot-air (simulated) balloons which use helium instead of hot air for lift.

DISCUSSION OF PRIOR ART

Heretofore, there has been no disclosure which solves the problem of accurately imitating in toy miniature the shape of the neck and the open mouth of the envelope of a full-sized hot-air balloon. These problems are overcome here by inserting a specifically shaped object into the mouth of a toy latex balloon and incorporating said object with a novel method of assembling the toy miniature balloon.

In U.S. Pat. No. 1,478,755 (Mulholland, 1923), a toy balloon is disclosed and three subsequent U.S. Pat. Nos. 4,758,199 (Tillotson et al, 1988), 4,784,628 (McArdle et al, 1988), and 4,884,987 (Mason, 1989) disclose various improvements to said toy balloon, none of which is similar to the improvements in this application.

In U.S. Pat. Nos. 1,370,178 (Albert, 1921), 2,992,795 (Fazio, et al, 1961), and 4,529.018 (Lichfield, 1985), various balloon neck-inserts are disclosed, but they have to do with valves and the regulation of gases within the envelope and make no effort with respect to the shape of the neck or the openness of the mouth of a toy imitation hot-air balloon.

OBJECTS AND ADVANTAGES

Miniatures which accurately mimic the full-sized object (trains, ships, airplanes, etc.) have a long history of popularity and commercial success. However, to date there has been no known successful marketing of a toy hot-air (simulated) balloon because of the obstacles involved in making a miniature imitation lifting envelope which closely resembles the lifting envelope of a full-sized hot-air balloon.

The improvements disclosed in this application overcome these obstacles and the vehicles for the improvements are the neck-insert FIG. 1 and the method of assembly which incorporates the neck-insert.

Until now, efforts to replicate in miniature the shape of the neck and the open mouth of a full-sized hot-air balloon lifting envelope have not been successful.

The prior art efforts relevant to the improvements set forth herein (U.S. Pat. Nos. 1,478,755, 4,758,199, 4,784,628, 4,884,987) attach external structures to the bottom of the miniature lifting envelope. These structures do succeed in hiding the closed nozzle of the envelope but they do not accurately imitate the shape of the neck or the open mouth of full-sized hot-air balloon envelopes because true hot-air balloon envelopes simply do not have such an external structure. The full-sized hot-air lifting envelope has a neck which approximates the shape of a cone (without the point) and a large open mouth (to receive heat from the burners).

The challenge is to replicate both features in miniature and the singular difficulty is to create an open mouth, or the appearance of an open mouth, without allowing helium to escape.

The neck-insert FIG. 1, used in conjunction with the unique method of assembly, succeeds in replicating both features, to wit:

1. Rather than form the open mouth and conical neck with an external structure, as does the prior art, and which does not exist on a full-sized hot-air balloon envelope, this application discloses an internal structure, i.e., the neck-insert. This object is fitted inside the open mouth of the imitation outer envelope 11, and is therefore barely visible. The elastic lip 6 of the imitation envelope 11 is fitted in and around the circular outer groove 15 of the neck-insert and is thus forced to conform to the round opening of the neck-insert, which results in the desired open mouth appearance.
2. The shape and positioning of the neck-insert forces the elastic neck 7 of the outer envelope 11 to adopt the desired conical shape.

Further objects and advantages will become apparent from the drawings and description.

List of Reference Numerals

Figure 1:
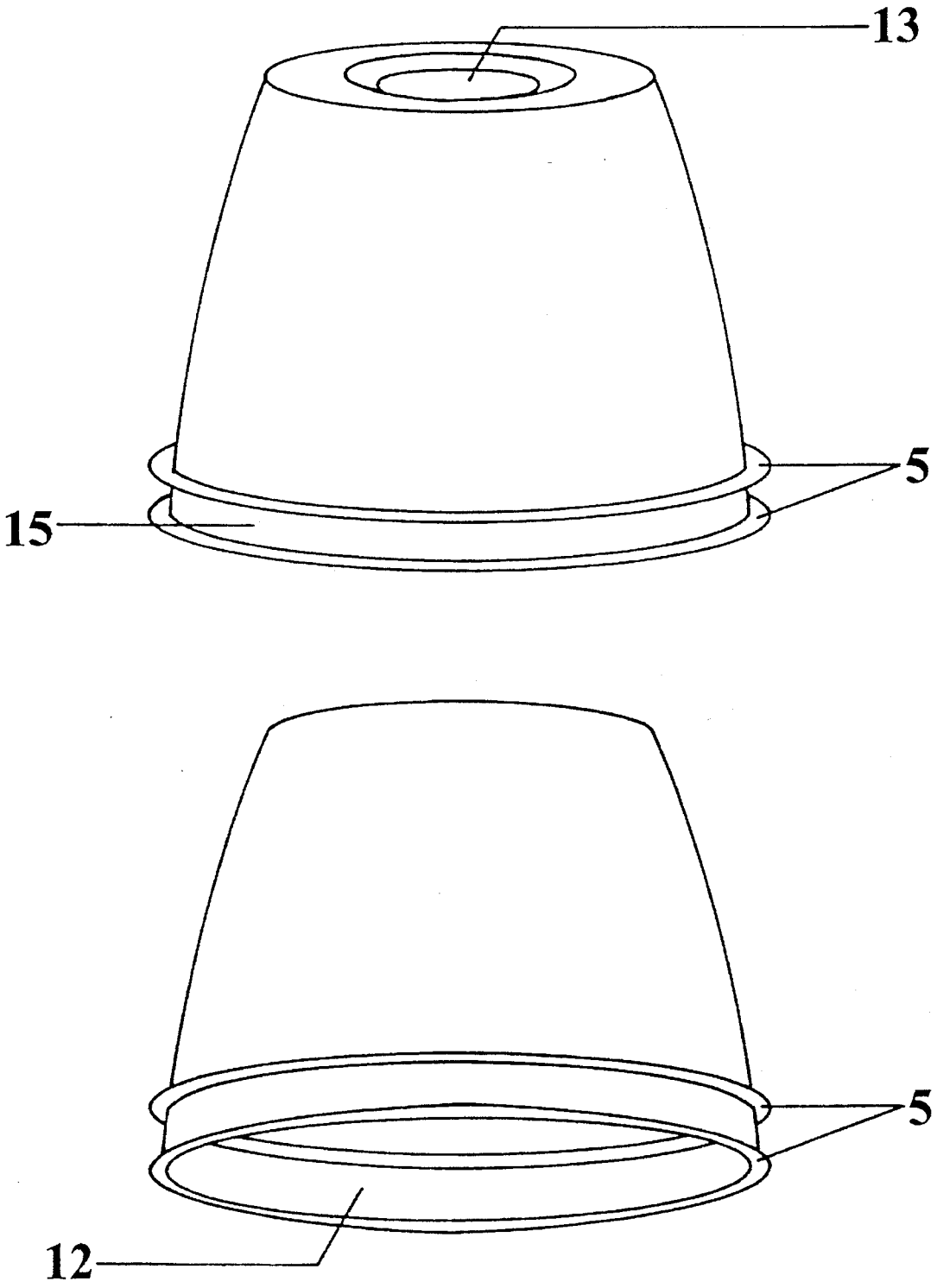
FIG. 1 upper and lower side views of the neck-insert

4 gondola
5 ridges
6 elastic band around lip of outer envelope
7 neck
8 mouth
9 inner envelope
10 closed nozzle
11 outer envelope
12 inner groove
13 indentation
14 ring
15 outer groove

DESCRIPTION OF INVENTION

Figure 2:
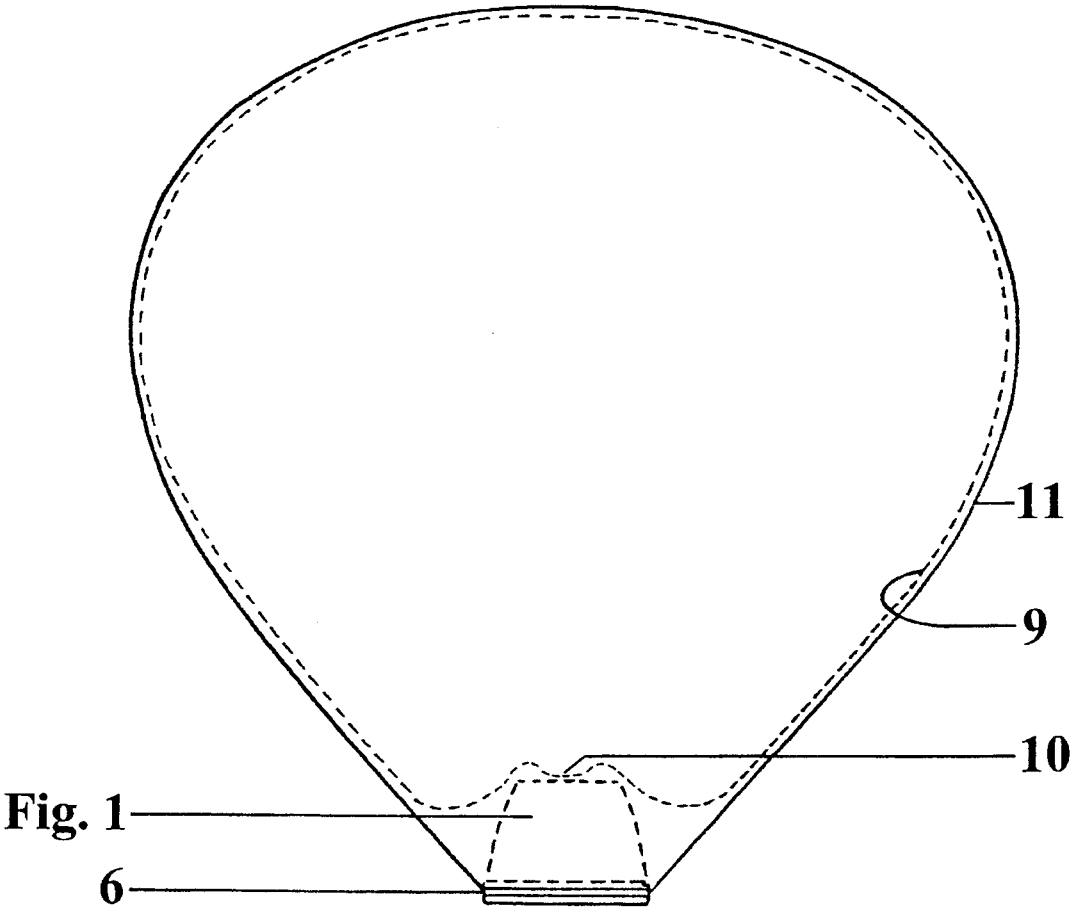
FIG. 2 side view of outer envelope, inflated inner envelope, and neck-insert in position FIG. 3 side view of balloon envelope and detached gondola

As seen in FIG. 2, the lifting envelope consists of one helium-filled latex balloon (inner envelope 9) inside another latex balloon (outer envelope 11).

The neck-insert FIG. 1, made of a lightweight material such as plastic, is inserted (closed end first) into the open mouth of the outer envelope 11 once the inner envelope 9 is inflated and sealed. The circular outer groove 15 on the neck-insert is designed to accommodate the lip 6 or neck 7 of the outer envelope and an elastic band 6.

The circular inner groove 12 along the inner wall of the neck-insert is designed to accommodate a removable ring 14 which anchors the lines linking the suspended gondola.

The indentation 13 is designed to accommodate the closed nozzle 10 of the inner envelope.

Figure 3:
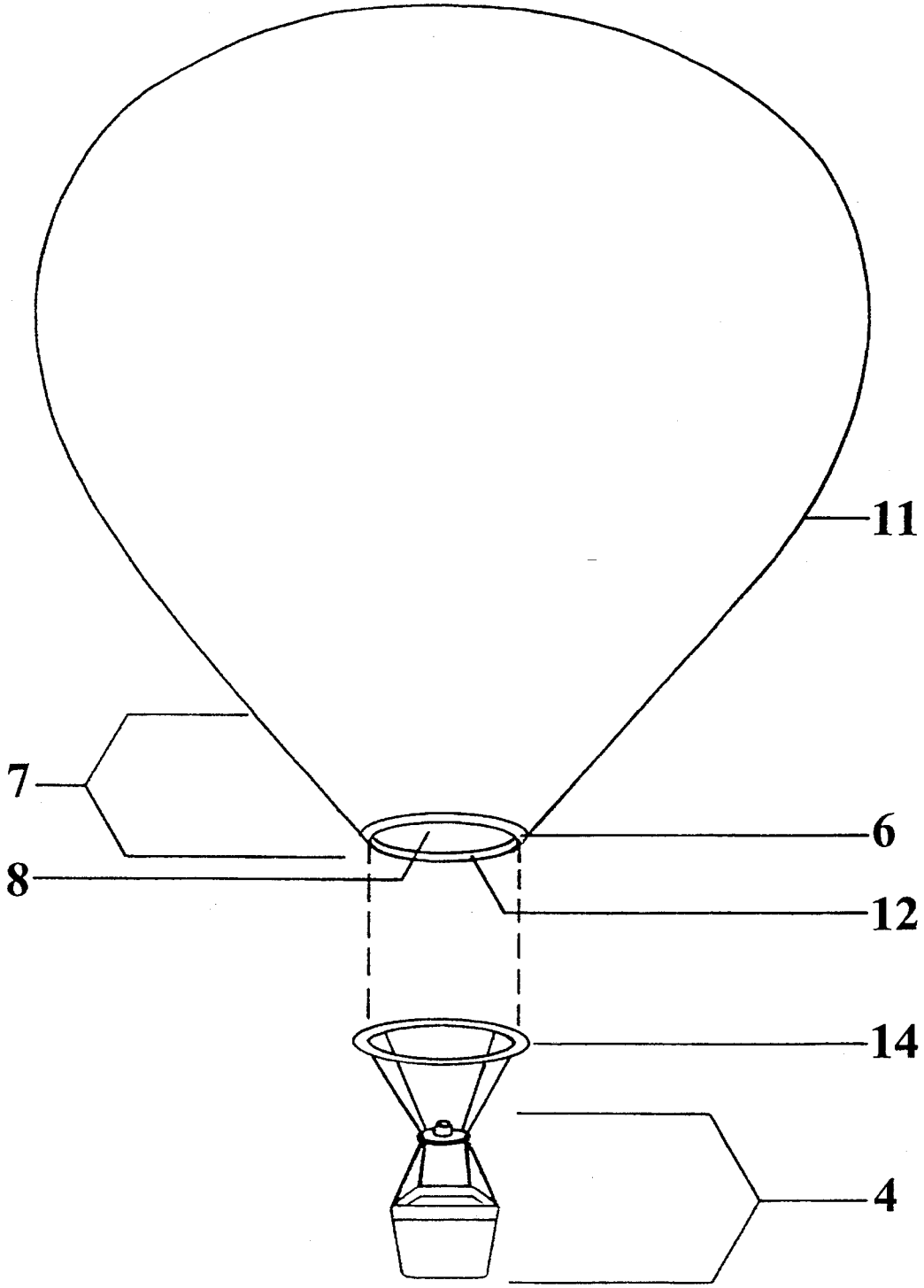

FIG. 3 is a full side view of the balloon envelope and detached gondola.

OPERATION OF INVENTION

An embodiment of part of the invention, the neck-insert, is illustrated in FIG. 1. The method of assembly which incorporates said neck-insert is illustrated in its completed form in FIG. 2 and is described as follows:

The inner envelope 9 is placed inside the outer envelope 11 and is inflated with helium and sealed. The neck-insert FIG. 1 is then inserted (closed end first) into the open mouth 8 of the outer envelope 11. The outer groove 15 on the neck-insert is designed to accommodate the lip 6 of the outer envelope.

An alternative method of assembly, relating to the attachment of the outer envelope to the neck-insert, is to stretch the neck of the outer envelope beyond the neck-insert and then to fit an elastic band 6 around the neck 7 at the point where the neck surrounds the outer groove 15 on the neck-insert. The excess balloon material beyond the elastic band is then trimmed away.

When installed, the neck-insert FIG. 1 has the following functions:

a. it forces the neck 7 of the outer envelope 11 to adopt the conical shape of the neck of a full-sized hot-air balloon envelope;

b. it forces the mouth 8 of the outer envelope 11 to conform in appearance to the open mouth of a full-sized hot-air balloon envelope;

c. it provides a seat (inner groove 12) for a removable ring 14 which anchors the lines connecting the gondola 4 to the lifting envelope The inner envelope can be eliminated when the lip of the outer envelope is tightly sealed to the neck-insert using the elastic band 6.

The toy balloon can be easily re-inflated by placing a small hole centrally in the closed end of the neck-insert, inserting the nozzle of the inner envelope through said hole, and introducing additional helium through said nozzle.

SUMMARY, RAMIFICATIONS, AND SCOPE OF INVENTION

These improvements result in an accurate replication in toy miniature of the shape of the neck and the open mouth of a full-sized hot-air balloon lifting envelope, which is pleasing to the eye, and an efficient method for the attachment and detachment of the gondola to the lifting envelope. Accordingly, a reliable and economical source of amusement and pleasure is provided for persons of almost any age.

While this invention contains many specifics, numerous variations in the size and shape of the parts are possible and various materials may be used.

Accordingly, the scope of the invention should be determined not by the embodiments illustrated, but by the appended claims and their legal equivalents.

I claim:

1. An insert for use with inner and outer toy balloons for accurately replicating in toy miniature the shape of a full sized hot air balloon, said insert comprising:

a hollow structure defining a sidewall, a first closed end and an opposed second open end;

said sidewall defining an outer surface and an opposed inner surface, wherein said inner surface defines a groove surrounding said second open end;

said groove removably accommodating a ring to which a toy gondola is attached to and suspended from;

a first ridge projecting from said outer surface and surrounding said second open end; and a second ridge projecting from said outer surface and spaced apart from said first ridge by a predetermined distance for removably receiving a portion of said outer toy balloon between said first and second ridges.

2. An insert as in claim 1 wherein said first closed end defines an outer surface having an indentation therein for receiving a portion of said inner toy balloon therein.

3. An insert as in claim 2 wherein said sidewall is substantially in the shape of a conical frustum.

4. A toy miniature replicating a full sized hot air balloon, said toy miniature comprising:

a first outer toy balloon defining an open mouth and having an elastic lip surrounding said mouth;

a second inner inflated toy balloon positioned within said first balloon; and an insert, as recited in claim 1, positioned within said open mouth of said first balloon with said lip positioned and held between said first and second ridges of said insert.

5. A toy miniature as in claim 1 wherein said ring is flexible to enable said ring to be inserted and removed from said groove of said insert.

6. A toy miniature as in claim 5 wherein said first and second balloons are latex balloons.

7. A method of assembling a toy miniature replicating a full sized hot air balloon, said method comprising the steps of:

providing a first toy balloon and a second toy balloon the first of which has an open mouth with an elastic lip surrounding said mouth;

inserting said second balloon inside said first balloon;

inflating said second toy balloon with gas while said balloon is inside said first balloon;

sealing said second toy balloon to retain said gas therein;

inserting an insert, as recited in claim 1, into said open mouth of said first balloon; and positioning said elastic lip of said first balloon around said insert and between said first and second ridges of said insert.

8. A method as in claim 7 further including the steps of:

providing a ring having a toy gondola attached to and suspended from said ring; and positioning said ring within said groove in said insert, whereby said toy gondola is suspended beneath said outer toy balloon.

9. A method of assembling a toy miniature replicating a full sized hot air balloon, said method comprising the steps of:

providing a first toy balloon which has a neck portion and an open mouth with an elastic lip surrounding said mouth of said balloon, and providing a second toy balloon;

inserting said second balloon inside said first balloon;

inflating said second toy balloon with gas while said balloon is inside said first balloon;

sealing said second toy balloon to retain said gas therein;

inserting an insert, as recited in claim 1, into said open mouth of said first balloon;

positioning said lip of said first balloon beyond said open end of said insert;

providing an elastic band;

positioning said elastic band around said insert, over said neck portion of said first balloon and between said first and second ridges of said insert; and trimming away a portion of said first balloon which extends beyond said elastic band.

10. A method as in claim 9 further including the steps of:

providing a ring having a toy gondola attached to and suspended from said ring; and positioning said ring within said groove in said insert, whereby said toy gondola is suspended beneath said outer toy balloon.

* * * * *